US008515770B2

(12) United States Patent
Keiler et al.

(10) Patent No.: US 8,515,770 B2
(45) Date of Patent: Aug. 20, 2013

(54) METHOD AND APPARATUS FOR ENCODING AND DECODING EXCITATION PATTERNS FROM WHICH THE MASKING LEVELS FOR AN AUDIO SIGNAL ENCODING AND DECODING ARE DETERMINED

(75) Inventors: Florian Keiler, Hannover (DE); Oliver Wuebbolt, Hannover (DE); Johannes Boehm, Goettingen (DE)

(73) Assignee: Thomson Licensing, Issy les Moulineaux (FR)

( * ) Notice: Subject to any disclaimer, the term of this patent is extended or adjusted under 35 U.S.C. 154(b) by 173 days.

(21) Appl. No.: 12/932,894

(22) Filed: Mar. 9, 2011

(65) Prior Publication Data

US 2011/0238424 A1 Sep. 29, 2011

(30) Foreign Application Priority Data

Mar. 24, 2010 (EP) ..... 10305295

(51) Int. Cl.
*G10L 19/00* (2013.01)

(52) U.S. Cl.
USPC ..... 704/500

(58) Field of Classification Search
USPC ..... 700/500; 704/500
See application file for complete search history.

(56) References Cited

U.S. PATENT DOCUMENTS

| | | | | |
|---|---|---|---|---|
| 6,965,700 | B2 * | 11/2005 | Pearlman et al. | 382/232 |
| 7,143,030 | B2 * | 11/2006 | Chen et al. | 704/219 |
| 8,290,782 | B2 * | 10/2012 | Shmunk | 704/500 |
| 2003/0115051 | A1 | 6/2003 | Chen et al. | |
| 2011/0166864 | A1 * | 7/2011 | Chen et al. | 704/500 |

OTHER PUBLICATIONS

W. A. Pearlman, A. Islam, N. Nagaraj, and A. Said, "Efficient, low-complexity image coding with a set-partitioning embedded block coder," IEEE Transactions on Circuits and Systems for Video Technology, vol. 14, No. 11, pp. 1219-1235, 2004.*

A. Islam and W. A. Pearlman, "Embedded and efficient low complexity hierarchical image coder," in Visual Communications and Image Processing, K. Aizawa, R. L. Stevenson, and Y.-Q. Zhang, Eds., vol. 3653 of Proceedings of SPIE, pp. 294-305, San Jose, Calif, USA, Jan. 1999.*

O. Niemeyer and B. Edler, "Efficient coding of excitation patterns combined with a transform audio coder," in Proc. 118th AES Convention, Barcelona, Spain, May 28-31, 2005, paper 6466.*

S. van de Par, V. Kot, and N. H. van Schijndel, "Scalable noise coder for parametric sound coding," in Proc. 118th AES Convention, Barcelona, Spain, May 28-31, 2005, paper 6465.*

Van De Par et al., "Scalable Nosie Coder for Parametric Sound Coding", AES Convention 118, New York, NY, May 1, 2005.

Niemeyer et al., "Efficient Coding of Excitation Patterns Combined with a Transform Audio Coder", AES Convention 118; New York, NY, May 1, 2005, p. 2.

Search Report dated Jul. 21, 2010.

* cited by examiner

*Primary Examiner* — Douglas Godbold
*Assistant Examiner* — Ernest Estes
(74) *Attorney, Agent, or Firm* — International IP Law Group, PLLC

(57) ABSTRACT

A method and apparatus for approximating a true masking threshold for the quantization of spectral data in an audio transform encoder. According to the invention, for each spectrum to be quantised in the audio signal encoding, an excitation pattern is computed and coded for both long and short window/transform lengths. The excitation patterns are grouped together in a variable-size matrix. A pre-determined sorting order with a fixed number of values only is applied to the excitation pattern data matrix values, and by that re-ordering a quadratic matrix is formed to which matrix' bit planes a SPECK encoding is applied.

17 Claims, 3 Drawing Sheets

METHOD AND APPARATUS FOR ENCODING AND DECODING EXCITATION PATTERNS FROM WHICH THE MASKING LEVELS FOR AN AUDIO SIGNAL ENCODING AND DECODING ARE DETERMINED

This application claims the benefit, under 35 U.S.C. §119 of EP Patent Application 10305295.7, filed 24 Mar. 2010.

FIELD OF THE INVENTION

The invention relates to a method and to an apparatus for encoding and decoding excitation patterns from which the masking levels for an audio signal transform codec are determined.

BACKGROUND OF THE INVENTION

For the quantisation of spectral data in an audio transform encoder psycho-acoustic information is required, i.e. an approximation of the true masking threshold. In a corresponding audio transform decoder the same approximation is used for reconstructing the quantised data. At encoder side, overlapping sections of the source signal are windowed using window functions. At decoder side, overlap+add is carried out for the decoded signal windows.

In order to limit the amount of side information data to be transmitted, known transform codecs like mp3 and AAC are using as masking information scale factors for critical bands (also denoted 'scale factor bands'), which means that for a group of neighbouring frequency bins or coefficients the same scale factor is used prior to the quantisation process. Cf. K. Brandenburg, M. Bosi: "ISO/IEC MPEG-2 Advanced Audio Coding: Overview and Applications", 103rd AES Convention, 26-29 Sep. 1997, New York, preprint No. 4641.

However, the scale factors are representing only a coarse (step-wise) approximation of the masking threshold. The accuracy of such representation of the masking threshold is very limited because groups of (slightly) different-amplitude frequency bins will get the same scale factor, and therefore the applied masking threshold is not optimum for a significant number of frequency bins.

For improving the encoding/decoding quality, the masking level can be computed as shown in:

S. van de Par, A. Kohlrausch, G. Charestan, R. Heusdens: "A new psychoacoustical masking model for audio coding applications", Proceedings ICASSP '02, IEEE International Conference on Acoustics, Speech and Signal Processing, 2002, Orlando, vol. 2, pp. 1805-1808;

S. van de Par, A. Kohlrausch, R. Heusdens, J. Jensen, S. H. Jensen: "A Perceptual Model for Sinusoidal Audio Coding Based on Spectral Integration", EURASIP Journal on Applied Signal Processing, vol. 2005:9, pp. 1292-1304, wherein the masking thresholds are derived from 'excitation patterns' which are derived from the power spectrum of the audio signal to be encoded.

An audio codec applying such excitation patterns for masking purposes is described in O. Niemeyer, B. Edler: "Efficient Coding of Excitation Patterns Combined with a Transform Audio Coder", 118th AES Convention, 28-31 May 2005, Barcelona, Paper 6466. For each spectral audio data block to be encoded an excitation pattern is computed, wherein the excitation patterns represent the (true) frequency-dependent psycho-acoustic properties of the human ear.

For avoiding a significant increase of the resulting data rate in comparison with scale factor based masking, in each case 16 successive excitation patterns are combined in order to efficiently encode these excitation patterns. The excitation pattern matrix values are SPECK (Set Partitioning Embedded bloCK) encoded as described for image coding applications in W. A. Pearlman, A. Islam, N. Nagaraj, A. Said: "Efficient, Low-Complexity Image Coding With a Set-Partitioning Embedded Block Coder", *IEEE Transactions on Circuits and Systems for Video Technology*, November 2004, vol. 14, no. 11, pp. 1219-1235.

The actual excitation pattern coding is performed following building with the excitation pattern values a 2-dimensional matrix over frequency and time, and a 2-dimensional DCT transform of the logarithmic-scale matrix values. The resulting transform coefficients are quantised and entropy encoded in bit planes, starting with the most significant one, whereby the SPECK-coded locations and the signs of the coefficients are transferred to the audio decoder as bit stream side information.

At encoder and at decoder side, the encoded excitation patterns are correspondingly decoded for calculating the masking thresholds to be applied in the audio signal encoding and decoding, so that the calculated masking thresholds are identical in both the encoder and the decoder. The audio signal quantisation is controlled by the resulting improved masking threshold.

Different window/transform lengths are used for the audio signal coding, and a fixed length is used for the excitation patterns.

A disadvantage of such excitation pattern audio encoding processing is the processing delay caused by coding together the excitation patterns for a number of blocks in the encoder, but a more accurate representation of the masking threshold for the coding of the spectral data can be achieved and thereby an increased encoding/decoding quality, while the combined excitation pattern coding of multiple blocks causes only a small increase of side information data.

SUMMARY OF THE INVENTION

In the above-mentioned Niemeyer/Edler processing, the masking thresholds derived from the excitation patterns are independent from the window and transform length selected in the audio signal coding. Instead, the excitation patterns are derived from fixed-length sections of the audio signal. However, a short window and transform length represents a higher time resolution and for optimum coding/decoding quality the level of the related masking threshold should be adapted correspondingly.

A problem to be solved by the invention is to further increase the quality of the audio signal encoding/decoding by improving the masking threshold calculation, without causing an increase of the side information data rate.

According to the invention, for each spectrum to be quantised in the coding of the audio signal, an excitation pattern is computed and coded, i.e. for every shorter window/transform its own excitation pattern is calculated and thereby the time resolution of the excitation patterns is variable. The excitation patterns for long windows/transforms and for shorter windows/transforms are grouped together in corresponding matrices or blocks. The amount of excitation pattern data is the same for both long and shorter window/transform lengths, i.e. for non-transient and for transient source signal sections. The excitation pattern matrix can therefore have a different number of rows in each frame.

Regarding the excitation pattern coding, following an optional logarithmic calculus of the matrix values, a predetermined scan or sorting order is applied to the two-dimensionally transformed excitation pattern data matrix values, and by that re-ordering a quadratic matrix can be formed to which matrix' bit planes the SPECK encoding is applied directly. A fixed number of values only of the scan path are coded.

In principle, the inventive encoding method is suited for encoding excitation patterns from which the masking levels for an audio signal encoding are determined following a corresponding excitation pattern decoding, wherein for said audio signal encoding said audio signal is processed successively using different window and spectral transform lengths and a section of the audio signal representing a given multiple of the longest transform length is denoted a frame, and wherein said excitation patterns are related to a spectral representation of successive sections of said audio signal, said method including the steps:

a) forming, for a current frame of said audio signal, in each case for a corresponding group of successive excitation patterns an excitation pattern matrix P, wherein for each one of said different spectral transform lengths a corresponding excitation pattern is included in said matrix P, and taking the logarithm of each matrix P entry, and wherein, in case the resulting matrix size is not suited for the transform of the following step, the size of the matrix is increased by copying a necessary number of times the values of an excitation pattern located at the matrix border;

b) applying a two-dimensional transform on the logarithmized matrix P values, resulting in matrix $P^T$;

c) applying a pre-determined sorting order to the coefficients in said matrix $P^T$, said pre-determined sorting order depending on the matrix size, which matrix size depends on the number of non-longest transform lengths in the current frame and is represented by a corresponding sorting index, and, taking only a fixed number of values of the corresponding sorting path starting from the first value, forming a quadratic version $P^{Tq}$ of matrix $P^T$ with these values;

d) carrying out a SPECK encoding for matrix $P^{Tq}$, in which SPECK encoding bit planes of the matrix $P^{Tq}$ are processed and a successive partitioning is used for locating and coding the positions of the corresponding coefficient bits in said bit planes.

In principle the inventive encoding apparatus is an audio signal encoder in which excitation patterns are encoded from which following a corresponding excitation pattern decoding the masking levels for an encoding of said audio signal are determined, wherein for encoding said audio signal it is processed successively using different window and spectral transform lengths and a section of the audio signal representing a given multiple of the longest transform length is denoted a frame, and wherein said excitation patterns are related to a spectral representation of successive sections of said audio signal, said apparatus including:

means being adapted for forming, for a current frame of said audio signal, in each case for a corresponding group of successive excitation patterns an excitation pattern matrix P, wherein for each one of said different spectral transform lengths a corresponding excitation pattern is included in said matrix P, and for taking the logarithm of each matrix P entry, and wherein, in case the resulting matrix size is not suited for the transform of the following step, the size of the matrix is increased by copying a necessary number of times the values of an excitation pattern located at the matrix border, and wherein a two-dimensional transform is applied on the logarithmized matrix P values, resulting in matrix $P^T$, and wherein a pre-determined sorting order is applied to the coefficients in said matrix $P^T$, said pre-determined sorting order depending on the matrix size, which matrix size depends on the number of non-longest transform lengths in the current frame and is represented by a corresponding sorting index, and wherein, taking only a fixed number of values of the corresponding sorting path starting from the first value, a quadratic version $P^{Tq}$ of matrix $P^T$ is formed with these values;

means being adapted for carrying out a SPECK encoding for matrix $P^{Tq}$, in which SPECK encoding bit planes of the matrix $P^{Tq}$ are processed and a successive partitioning is used for locating and coding the positions of the corresponding coefficient bits in said bit planes.

In principle, the inventive decoding method is suited for decoding excitation patterns that were encoded according to the above encoding method, from which excitation patterns the masking levels for an encoded audio signal decoding are determined, wherein for said audio signal decoding said audio signal is processed successively using different window and spectral inverse transform lengths and a section of the audio signal representing a given multiple of the longest transform length is denoted a frame, and wherein said excitation patterns are related to a spectral representation of successive sections of said audio signal, said method including the steps:

a) on the corresponding data received from the bitstream, carrying out a corresponding SPECK decoding for said quadratic matrix $P^{Tq}$;

b) appending zeros to the reconstructed matrix $P^{Tq}$ data in order to regain the original number of data in the sorting path as used in the encoding, and converting back these data to the reconstructed matrix $P^T$ by applying—according to the sorting index for the current matrix—the inverse sorting order as used in the encoding, wherein that sorting index is also used to establish the appropriate matrix size;

c) applying on matrix $P^T$ the corresponding inverse two-dimensional transform and the inverse logarithm in order to regain the reconstructed excitation pattern matrix P.

In principle the inventive decoding apparatus is an audio signal decoder in which excitation patterns encoded according to the above encoding method are decoded and used for determining the masking levels for the decoding of the encoded audio signal, wherein for decoding said audio signal it is processed successively using different window and spectral inverse transform lengths and a section of the audio signal representing a given multiple of the longest transform length is denoted a frame, and wherein said excitation patterns are related to a spectral representation of successive sections of said audio signal, said apparatus including:

means being adapted for carrying out—on the corresponding data received from the bitstream—a corresponding SPECK decoding for said quadratic matrix $P^{Tq}$, and for appending zeros to the reconstructed matrix $P^{Tq}$ data in order to regain the original number of data in the sorting path as used in the encoding, and for converting back these data to the reconstructed matrix $P^T$ by applying—according to the sorting index for the current matrix—the inverse sorting order as used in the encoding, wherein that sorting index is also used to establish the appropriate matrix size;

and for applying on matrix $P^T$ the corresponding inverse two-dimensional transform and the inverse logarithm in order to regain the reconstructed excitation pattern matrix P;

means being adapted for calculating from the excitation patterns of matrix P said masking thresholds;

means being adapted for decoding and re-quantising said encoded audio signal using said masking thresholds, and for inverse transforming the resulting signal and for applying on it an overlap+add processing.

Advantageous additional embodiments of the invention are disclosed in the respective dependent claims.

BRIEF DESCRIPTION OF THE DRAWINGS

Exemplary embodiments of the invention are described with reference to the accompanying drawings, which show in.

DETAILED DESCRIPTION

Figure 1:
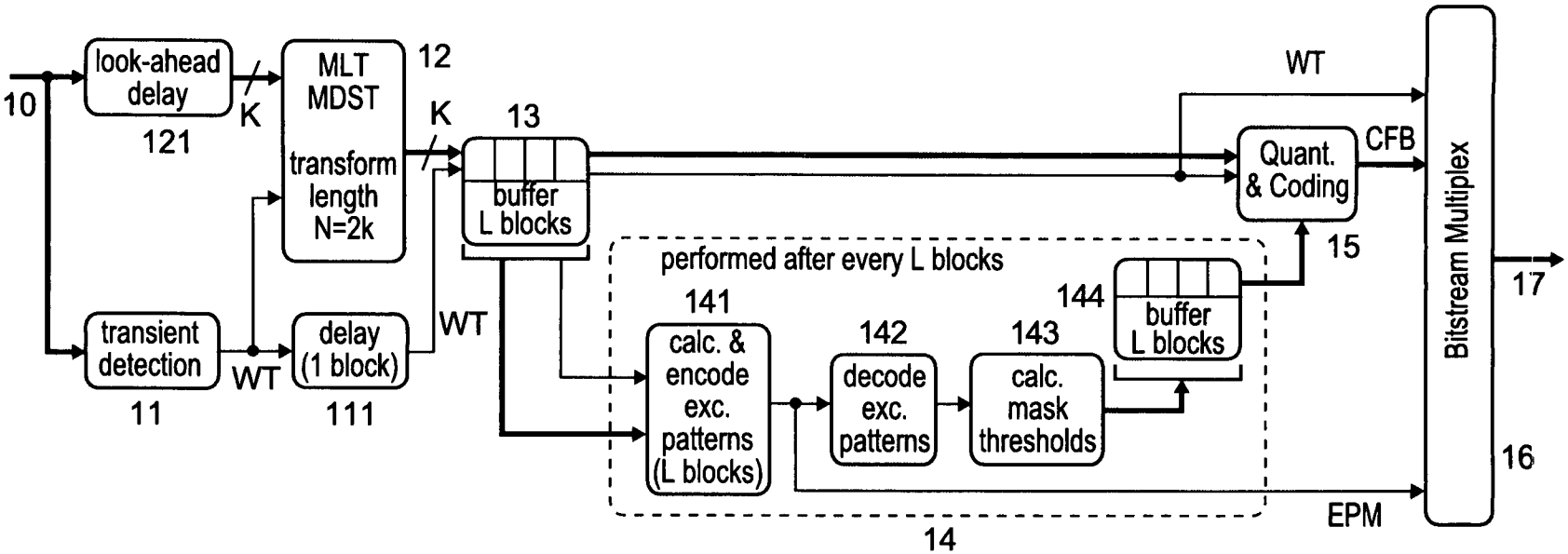
FIG. 1 block diagram for the inventive encoder.

In the block diagram for the inventive audio transform encoder in FIG. 1, the audio input signal 10 passes through a look-ahead delay 121 to a transient detector step or stage 11 that selects the current window type WT to be applied on input signal 10 in a frequency transform step or stage 12. In step/stage 12 a Modulated Lapped Transform (MLT) with a block length corresponding to the current window type is used, for example an MDCT (modified discrete cosine transform). Successive sections of K input signal samples are input to step/stage 12, wherein K has a value of e.g. '128' or '1024'. Due to the 50% window overlap, the transform length is N=2*K. The transformed audio signal is quantised and entropy encoded in a corresponding stage/step 15. It is not necessary that the transform coefficients are processed block-wise in stage/step 15, like the excitation pattern block processing in step/stage 14. The coded frequency bins CFB, the window type code WT, the excitation data matrix code EPM, and possibly other side information data are multiplexed in a bitstream multiplexer step/stage 16 that outputs the encoded bitstream 17.

As mentioned above, the power spectrum is required for the computation of the excitation patterns in section 14. For getting the power spectrum, the current windowed signal block is also transformed in step/stage 12 using an MDST (modified discrete sine transform). Both frequency representations, of types MLT and MDST, are fed to a buffer 13 that stores up to L blocks, wherein L is e.g. '8' or '16'. The current window type code is also fed to buffer 13, via a delay 111 corresponding to one block transform period. The output of each transform contains K frequency bins for one signal block. In case a transient is detected in step/stage 11, the time domain input signal is windowed by an integer number of $L_S$ short windows (i.e. blocks) instead of a single long window of length N=2K, wherein $L_S$ is e.g. '3' or '8' and wherein the total number of frequency bins for all short windows of one long signal block is K.

A number of L signal blocks form a data group, denoted 'frame'. The excitation pattern coding is applied to the excitation patterns of a frame in step/stage 141. For each spectrum to be quantised later on, one excitation pattern is computed. This feature is different to the audio coding described in the Brandenburg and the Niemeyer/Edler publications mentioned above and to the corresponding feature in the following standards, where a fixed time resolution of the excitation patterns is used:

International Standard ISO/IEC 11172-3: "Information technology—Coding of moving pictures and associated audio for digital storage media at up to about 1.5 Mbit/s—Part 3: Audio".

International Standard ISO/IEC 13818-3: "Information technology—Generic coding of moving pictures and associated audio information—Part 3: Audio".

The amount of excitation pattern data is the same for both long and short transform lengths. As a consequence, for a signal block containing short windows more excitation pattern data have to be encoded than for a signal block containing a long window.

The excitation patterns to be encoded are preferably arranged within a matrix P that has a non-quadratic shape. Each row of the matrix contains one excitation pattern corresponding to one spectrum to be quantised. Thus, the row and column indices correspond to the time and frequency axes, respectively. The number of rows in matrix P is at least L, but in contrast to the processing described in the Niemeyer/Edler publication, the matrix P can have a different number of rows in each frame because that number will depend on the number of short windows in the corresponding frame.

As an alternative, rows and columns of matrix P can be exchanged.

For applying a 2-dimensional transform (e.g. by using two cascaded 1-dimensional DCTs), the last row (or even more rows) of the matrix can be duplicated in order to get a number of rows (e.g. an even number) that the transform can handle.

Table 1 shows an example for a frame with one block using short windows, which would result in 11 rows. Because the 2-dimensional transform can handle input sizes that are a multiple of '4', the last row is duplicated:

TABLE 1

Example for window sequence in a frame (L = 8, $L_S$ = 4)

| Block index | Window type | Pattern index |
|---|---|---|
| 1 | long | 1 |
| 2 | start | 2 |
| 3 | short | 3 |
| 3 | short | 4 |
| 3 | short | 5 |
| 3 | short | 6 |
| 4 | stop | 7 |
| 5 | long | 8 |
| 6 | long | 9 |
| 7 | long | 10 |
| 8 | long | 11 |
| 8 (duplicated) | (long) | 12 |

Figure 3:
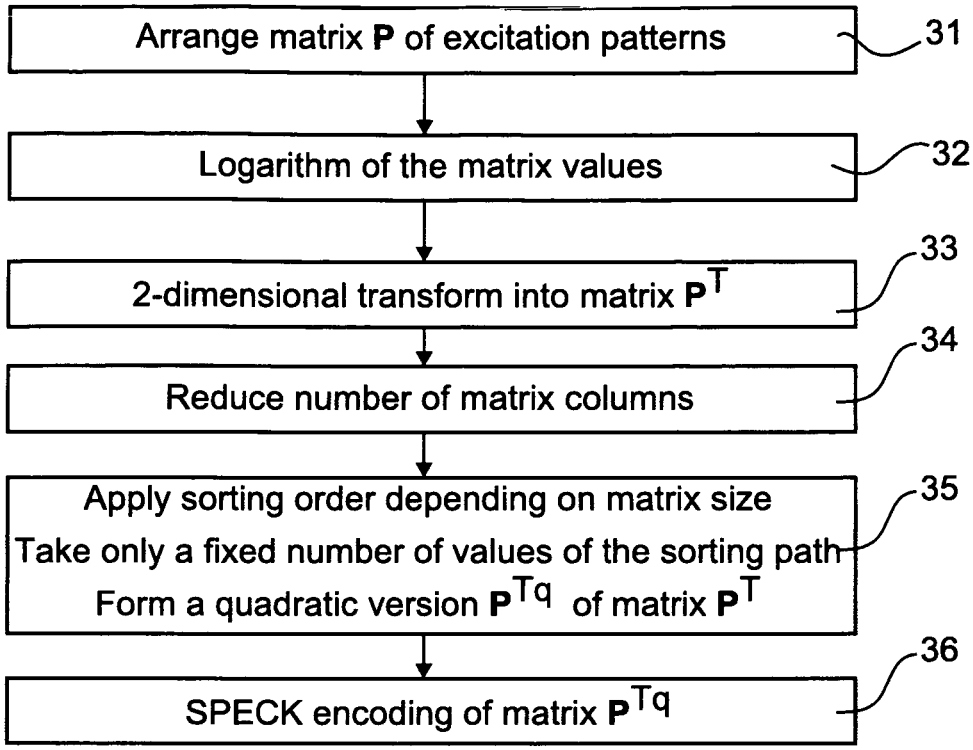
FIG. 3 flow chart for excitation pattern encoding.

Similar to section 3.2 in the Niemeyer/Edler publication mentioned above, the actual coding of the excitation pattern matrix P is performed as follows (see also FIG. 3), but there are several important differences:

a) Take the logarithm of each matrix P entry.

b) On the resulting matrix values, apply a 2-dimensional transform (i.e., the spectral excitation pattern representation is transformed again, denoted as matrix $P^T$).

c) Reduce the number of the transformed-matrix $P^T$ columns to be coded (e.g. by removing the matrix $P^T$ columns representing high-frequency content that usually has very small magnitudes).

d) Apply a pre-determined scan order (i.e. a pre-determined sorting) to the coefficients of the transformed-matrix $P^T$. In a pre-processing, the scan or sorting order for each matrix size (i.e. depending on the number of excitation patterns for short windows per matrix P) has been determined by performing training with representative input signals.

Remark: in the ideal case, the absolute values of the transformed-matrix $P^T$ coefficients are now arranged in descending order along the scan path.

e) Further reduce the number of data to be encoded by using only a fixed number of values of the scan or sorting path, i.e. omit the corresponding values at the end of the scan path, and form a quadratic version $P^{Tq}$ of matrix $P^T$, for example by filling the quadratic matrix $P^{Tq}$ line by line, or column by column, with the values from the scan path. The fixed number has also been determined in a prior training process.

The quadratic matrix $P^{Tq}$ can also be represented in the processing by a corresponding vector.

f) Carry out for matrix $P^{Tq}$ the SPECK processing described in sections II. and III, III.A-D in the above-mentioned Pearlman et al. publication, whereby bit planes of the quadratic matrix $P^{Tq}$ are processed and a continued partitioning is used to locate and code the positions of the corresponding coefficient bits in the bit planes.

Bits representing the signs of the coefficients of quadratic matrix $P^{Tq}$ can be added to the EPM code data, or can be added directly (i.e. without a specific encoding) to the bitstream in multiplexer 16.

When compared to the Niemeyer/Edler publication, the excitation pattern encoding processing differs in the steps c), d) and e) listed above. Step c) is performed additionally in the inventive processing. Regarding step d), a re-ordering of the matrix $P^T$ coefficients is carried out, which re-ordering is different for different matrix sizes.

Regarding step e), the re-ordering or scanning has two advantages over the Niemeyer/Edler processing:

The resulting matrix $P^{Tq}$ is quadratic so that the SPECK processing on the bit planes can be applied directly, while in Niemeyer/Edler the rectangular matrix needs to be split up into several quadratic matrices before the original SPECK processing can be carried out. Otherwise the original SPECK processing needs to be changed.

Because within the applied scanning paths the last matrix coefficients will very likely have the smallest magnitudes, coding only a fixed number of coefficients will omit negligible-amplitude coefficients only, whereas in Niemeyer/Edler the coding loop is stopped if either a "sufficient approximation of the transform coefficient matrix is achieved" or "a given bit rate constraint is met" by "skipping one or more lowest bit planes". I.e., in Niemeyer/Edler the omitted coefficients can include some significant coefficients and/or all coefficients of the matrix can get a coarser quantisation.

In step d), a sorting or scanning order for matrix $P^T$ for each possible matrix P size has to be provided, e.g. by determining a sorting index under which a corresponding scanning path is stored in a memory of the audio encoder and in a memory of the audio decoder.

In a training phase carried out once for all types of audio signals, statistics for all matrix elements are collected. For that purpose, for example for multiple test matrices for different types of audio signals, the squared values for each matrix entry are calculated and are averaged over the test matrices for each value position within the matrix. Then, the order of amplitudes represents the order of sorting. This kind of processing is carried out for all possible matrix sizes, and a corresponding sorting index is assigned to the sorting order for each matrix size. These sorting indices are used for (automatically) selecting a scan or sorting order in the excitation pattern matrix encoding and decoding process.

As stated in above step e), the number of values to be encoded is further reduced. From the statistics (determined in the training phase) a fixed number of values to be coded is evaluated: following sorting, only the number of values is used that add up to a given threshold of the total energy, for example 0.999.

In the audio signal encoder, the excitation data matrix code EPM can include the sorting index information. As an alternative which saves overall data rate, at decoder side the matrix size and thereby the sorting index is automatically determined from the number of short windows (signalled by the window type code WT) per frame. The excitation patterns encoded in step/stage 141 are decoded as described below in an excitation pattern decoder step or stage 142. From the decoded excitation patterns for the L blocks the corresponding masking thresholds are calculated in a masking threshold calculator step/stage 143, the output of which is intermediately stored in a buffer 144 that supplies the quantisation and entropy coding stage/step 15 with the current masking threshold for each transform coefficient received from step/stage 12 and buffer 13. The quantisation and entropy coding stage/step 15 supplies bitstream multiplexer 16 with the coded frequency bins CFB.

Figure 2:
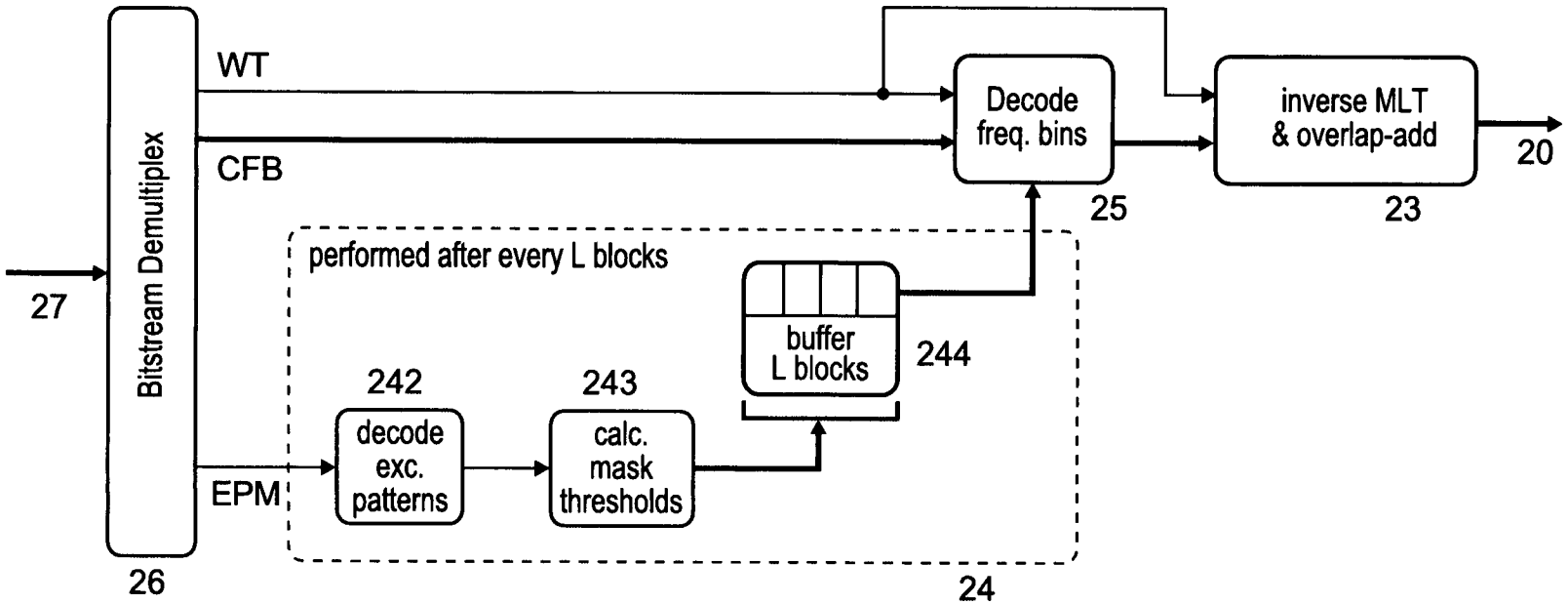
FIG. 2 block diagram for the inventive decoder.

In the inventive decoder shown in FIG. 2, the received encoded bitstream 27 is split up in a bitstream demultiplexer step/stage 26 into the window type code WT, the coded frequency bins CFB, the excitation pattern data matrix code EPM, and possibly other side information data. The entropy encoded CFB data are entropy decoded and de-quantised in a corresponding stage/step 25, using the window type code WT and the masking threshold information calculated in an excitation pattern block processing step/stage 24. The reconstructed frequency bins are inversely MLT transformed and overlap+add processed with a block length corresponding to the current window type code WT in an inverse transform/overlap+add step/stage 23 that outputs the reconstructed audio signal 20.

The excitation pattern data matrix code EPM is decoded in an excitation pattern decoder 242, whereby a correspondingly inverse SPECK processing provides a copy of matrix $P^{Tq}$, a correspondingly inverse scanning provides a copy of transformed-matrix $P^T$, and a correspondingly inverse transform provides reconstructed matrix P for a current block. The excitation patterns of reconstructed matrix P are used in a masking threshold calculation step/stage 243 for reconstructing the masking thresholds for the current block, which are intermediately stored in a buffer 244 and are supplied to stage/step 25.

Figure 4:
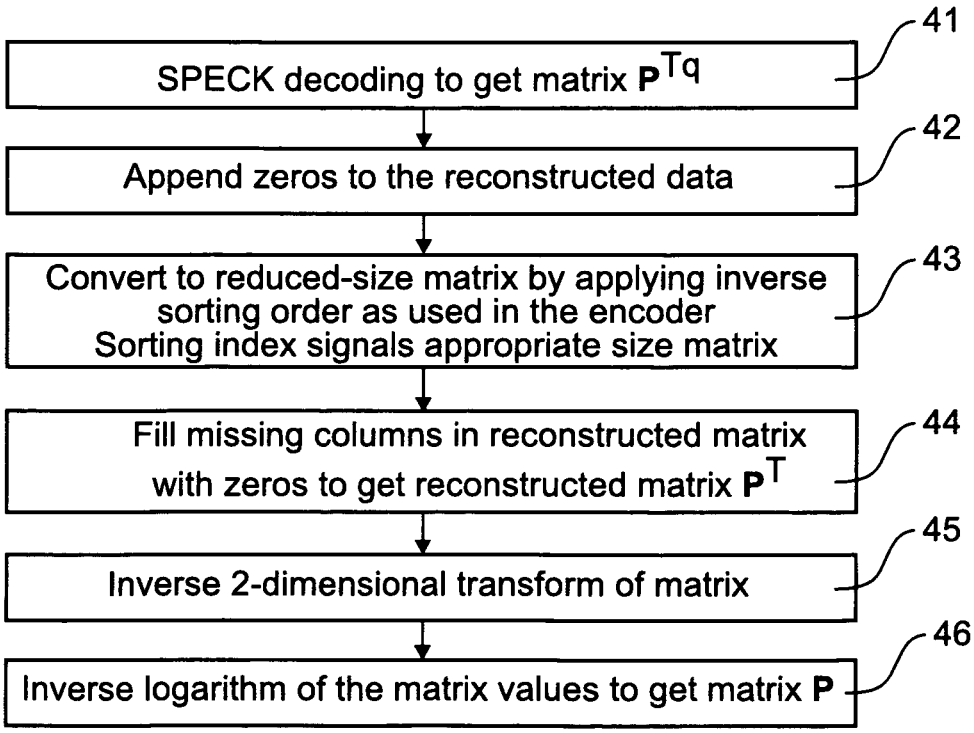
FIG. 4 flow chart for excitation pattern decoding.

The following steps are performed in excitation pattern decoder 242 for reconstructing the excitation patterns (see also FIG. 4):

A) Applying the corresponding SPECK decoding processing.

B) Appending zeros to the reconstructed matrix $P^{Tq}$ data to get the same (i.e. original) number of data in the scanning or sorting path as used in the encoder.

C) Converting back these data to a reduced-size transformed-matrix by applying the inverse sorting order as used in the encoder, wherein the related sorting index is also used to convert the decoded data back into a matrix of appropriate size.

D) Filling the missing columns in that reconstructed matrix with zeros in order to get reconstructed matrix $P^T$.

E) Applying the inverse 2-dimensional transform to get a reconstructed matrix.

F) Taking the inverse logarithm of all matrix entries to get the reconstructed excitation pattern matrix P.

Excitation Pattern Coding of Stereo/Multi-Channel Signals

When processing stereo input signals or, more generally, multi-channel signals the correlation between the channels can be exploited in the excitation pattern coding. For example, a synchronised transient detection can be used where all channel signals are processed with the same window type. I.e., for each channel $n_{ch}$ an excitation pattern matrix $P(n_{ch})$ of the same size is obtained. The individual matrices can be coded in different multi-channel coding modes k (where in the stereo case L and R denote the data corresponding to the left and right channel):

Interleaved excitation patterns per channel: LRLR . . . LR;

Combined matrix with channel data: LL . . . LRR . . . R;

One individual matrix for each channel.

In the encoder, all three coding modes k can be carried out and the excitation patterns are decoded from the candidate or temporary bit streams resulting in matrices $P'(n_{ch}, k)$. For each multi-channel coding mode k, the distortion d(k) of the applied coding is computed:

$$d(k) = \sum_{n_{ch}=1}^{N_{ch}} \sum_{rows} \sum_{columns} (10 \cdot \log_{10}(P(n_{ch})) - 10 \cdot \log_{10}(P'(n_{ch}, k)))^2$$

From these temporary bit streams the required data amounts s(k) are evaluated in the encoder. Preferably, the coding mode actually used is the one where the minimum of the product d(k)*s(k) is achieved. The corresponding bit stream data of this coding mode are transmitted to the decoder. As further side information, the multi-channel coding mode index k is also transmitted to the decoder.

The invention claimed is:

1. Method for encoding excitation patterns from which the masking levels for an audio signal encoding are determined following a corresponding excitation pattern decoding, wherein for said audio signal encoding said audio signal is processed successively using different window and spectral transform lengths and a section of the audio signal representing a given multiple of the longest transform length is denoted a frame, and wherein said excitation patterns are related to a spectral representation of successive sections of said audio signal, said method including the steps:

a) forming, for a current frame of said audio signal, in each case for a corresponding group of successive excitation patterns an excitation pattern matrix P, wherein for each one of said different spectral transform lengths a corresponding excitation pattern is included in said matrix P, and taking the logarithm of each matrix P entry, and wherein, in case the resulting matrix size is not suited for the transform of the following step, the size of the matrix is increased by copying a necessary number of times the values of an excitation pattern located at the matrix border;

b) applying a two-dimensional transform on the logarithmized matrix P values, resulting in matrix $P^T$;

c) applying a pre-determined sorting order to the coefficients in said matrix $P^T$, said pre-determined sorting order depending on the matrix size, which matrix size depends on the number of non-longest transform lengths in the current frame and is represented by a corresponding sorting index, and, taking only a fixed number of values of the corresponding sorting path starting from the first value, forming a quadratic version $P^{Tq}$ of matrix $P^T$ with these values; and d) carrying out an encoding operation according to a set partitioning embedded block (SPECK) algorithm for matrix $P^{Tq}$, in which encoding bit planes of the matrix $P^{Tq}$ are processed and a successive partitioning is used for locating and coding the positions of the corresponding coefficient bits in said bit planes.

2. Method for decoding excitation patterns that were encoded according to the method of claim 1, from which excitation patterns the masking levels for an encoded audio signal decoding are determined, wherein for said audio signal decoding said audio signal is processed successively using different window and spectral inverse transform lengths and a section of the audio signal representing a given multiple of the longest transform length is denoted a frame, and wherein said excitation patterns are related to a spectral representation of successive sections of said audio signal, said method including the steps:

a) on the corresponding data received from the bitstream, carrying out a corresponding decoding for said quadratic matrix $P^{Tq}$;

b) appending zeros to the reconstructed matrix $P^{Tq}$ data in order to regain the original number of data in the sorting path as used in the encoding, and converting back these data to the reconstructed matrix $P^T$ by applying—according to the sorting index for the current matrix—the inverse sorting order as used in the encoding, wherein that sorting index is also used to establish the appropriate matrix size; and c) applying on matrix $P^T$ the corresponding inverse two-dimensional transform and the inverse logarithm in order to regain the reconstructed excitation pattern matrix P.

3. Method according to claim 1, wherein between steps b) and c) the size of matrix $P^T$ is reduced by removing at least one matrix border column or row that represents frequencies statistically having the lowest magnitudes.

4. Method according to claim 2, wherein a window type code for signalling the current window and spectral transform length and optionally a sorting index signalling the current matrix size are included in the encoded audio signal bitstream.

5. Method according to claim 2, wherein between steps b) and c) the missing values for the matrix border columns or lines—that represented frequencies statistically having the lowest magnitudes—are filled with zeros in order to regain said reconstructed matrix $P^T$.

6. Method according to claim 2, wherein the matrix size and thereby the sorting index is automatically determined from the number of short windows per frame.

7. Method according to claim 1, wherein said window and spectral transform lengths have two types: long and short, and wherein the short windows are preceded by a start window and succeeded by a stop window.

8. Method according to claim 1, wherein the bits representing the signs of the values of matrix $P^{Tq}$ are included without a specific encoding in the encoded audio signal bitstream.

9. Method according to claim 1, wherein in case that audio signal is a multi-channel audio signal, for a current frame in all channels the same matrix size is used in the excitation pattern encoding and the individual matrices are coded in at least one of the following multi-channel coding modes k:

Interleaved excitation patterns per channel;

Combined matrix with channel data;

One individual matrix for each channel, and wherein code representing said coding modes k is included in the bitstream and is correspondingly used in the excitation pattern decoding processing.

10. Audio signal encoder in which excitation patterns are encoded from which the masking levels for an encoding of an audio signal are determined following a corresponding excitation pattern decoding, wherein for encoding said audio signal it is processed successively using different window and spectral transform lengths and a section of the audio signal representing a given multiple of the longest transform length is denoted a frame, and wherein said excitation patterns are related to a spectral representation of successive sections of said audio signal, said apparatus including:

a mechanism that forms, for a current frame of said audio signal, in each case for a corresponding group of successive excitation patterns an excitation pattern matrix P, wherein for each one of said different spectral transform lengths a corresponding excitation pattern is included in said matrix P, and for taking the logarithm of each matrix P entry, and wherein, in case the resulting matrix size is not suited for the transform of the following step, the size of the matrix is increased by copying a necessary number of times the values of an excitation pattern located at the matrix border, and wherein a two-dimensional transform is applied on the logarithmized matrix P values, resulting in matrix $P^T$, and wherein a pre-determined sorting order is applied to the coefficients in said matrix $P^T$, said pre-determined sorting order depending on the matrix size, which matrix size depends on the number of non-longest transform lengths in the current frame and is represented by a corresponding sorting index, and wherein, taking only a fixed number of values of the corresponding sorting path starting from the first value, a quadratic version $P^{Tq}$ of matrix $P^T$ is formed with these values; and a second mechanism that performs an encoding operation for matrix $P^{Tq}$ using a set partitioning embedded block (SPECK) algorithm, in which encoding bit planes of the matrix $P^{Tq}$ are processed and a successive partitioning is used for locating and coding the positions of the corresponding coefficient bits in said bit planes.

11. Audio signal decoder in which excitation patterns encoded according to the method of claim 1 are decoded and used for determining the masking levels for the decoding of the encoded audio signal, wherein for decoding said audio signal it is processed successively using different window and spectral inverse transform lengths and a section of the audio signal representing a given multiple of the longest transform length is denoted a frame, and wherein said excitation patterns are related to a spectral representation of successive sections of said audio signal, said apparatus including: means being adapted for carrying out—on the corresponding data received from the bitstream—a corresponding set partitioning embedded block (SPECK) decoding for said quadratic matrix $P^{Tq}$, and for appending zeros to the reconstructed matrix $P^{Tq}$ data in order to regain the original number of data in the sorting path as used in the encoding, and for converting back these data to the reconstructed matrix $P^T$ by applying-according to the sorting index for the current matrix—the inverse sorting order as used in the encoding, wherein that sorting index is also used to establish the appropriate matrix size; and for applying on matrix $P^T$ the corresponding inverse two-dimensional transform and the inverse logarithm in order to regain the reconstructed excitation pattern matrix P; means being adapted for calculating from the excitation patterns of matrix P said masking thresholds; means being adapted for decoding and re-quantising said encoded audio signal using said masking thresholds, and for inverse transforming the resulting signal and for applying on it an overlap+add processing.

12. Apparatus according to claim 10, wherein between said two-dimensional transform and said applying of said predetermined sorting order the size of matrix $P^T$ is reduced by removing at least one matrix border column or line that represents frequencies statistically having the lowest magnitudes.

13. Apparatus to claim 10, wherein a window type code for signalling the current window and spectral transform length and optionally a sorting index signalling the current matrix size are included in the encoded audio signal bitstream.

14. Apparatus according to claim 11, wherein following said inverse sorting the missing values for the matrix border columns or lines—that represented frequencies statistically having the lowest magnitudes—are filled with zeros in order to regain said reconstructed matrix $P^T$.

15. Apparatus according to claim 11, wherein the matrix size and thereby the sorting index is automatically determined from the number of short windows per frame.

16. Apparatus according to claim 10, wherein said window and spectral transform lengths have two types: long and short, and wherein the short windows are preceded by a start window and succeeded by a stop window.

17. Apparatus according to claim 10, wherein the bits representing the signs of the values of matrix $P^{Tq}$ are included without a specific encoding in the encoded audio signal bitstream.

* * * * *